United States Patent [19]

Simpson et al.

[11] Patent Number: 4,528,784

[45] Date of Patent: Jul. 16, 1985

[54] DUAL GUTTER ASSEMBLY FOR PREFABRICATED BUILDINGS

[75] Inventors: Harold G. Simpson, Oklahoma City; Leo E. Neyer, Edmond, both of Okla.

[73] Assignee: Nucor Corporation, Charlotte, N.C.

[21] Appl. No.: 494,858

[22] Filed: May 16, 1983

[51] Int. Cl.[3] ..... E04D 13/00

[52] U.S. Cl. ..... 52/14; 52/60; 52/95; 52/97

[58] Field of Search ..... 52/11, 12, 13, 14, 15, 52/16, 58, 60, 95–97, 408, 199

[56] References Cited

U.S. PATENT DOCUMENTS

| | | | |
|---|---|---|---|
| 287,632 | 10/1883 | Cooper . | |
| 870,917 | 11/1907 | Weston . | |
| 1,076,290 | 10/1913 | King . | |
| 3,735,596 | 5/1973 | Stephenson | 52/13 X |
| 4,397,126 | 8/1983 | Nelson | 52/408 X |

FOREIGN PATENT DOCUMENTS

| | | | |
|---|---|---|---|
| 2412386 | 9/1974 | Fed. Rep. of Germany | 52/199 |
| 1529221 | 6/1968 | France | 52/11 |
| 141421 | 4/1978 | Japan | 52/11 |
| 1502137 | 2/1978 | United Kingdom | 52/11 |

*Primary Examiner*—Donald G. Kelly
*Assistant Examiner*—Naoko N. Slack
*Attorney, Agent, or Firm*—Shenier & O'Connor

[57] ABSTRACT

A gutter assembly for collecting drainage from a building portion such as adjacent roof sections forming a valley in which a primary gutter preferably comprising a plurality of telescoping gutter sections is disposed along the building portion, while a flexible liquid-impervious membrane extends continuously along the building portion beneath the primary gutter to catch any drainage escaping therefrom. A secondary gutter also preferably comprising a plurality of telescoping gutter sections supports the membrane along its length beneath the primary gutter to ensure against rupture of the flexible membrane from liquid pressure.

20 Claims, 9 Drawing Figures

DUAL GUTTER ASSEMBLY FOR PREFABRICATED BUILDINGS

FIELD OF THE INVENTION

This invention relates to a dual gutter assembly for prefabricated buildings and, more particularly, to a gutter assembly for covering the valley formed by two adjacent roof sections of such a building.

BACKGROUND OF THE INVENTION

Gutter assemblies for collecting the drainage from the valley formed by two adjacent roof sections of a building are well known in the art. Typical assemblies of this type are shown in Stephenson U.S. Pat. No. 3,735,596, Beals U.S. Pat. No. 3,264,790 and Colby U.S. Pat. No. 2,736,397. Gutter assemblies of this type comprising cooperating primary gutters and secondary, or backup, gutters extending beneath the primary gutters are also well known in the art, being shown, for example, in Rice U.S. Pat. No. 884,208, Weston U.S. Pat. No. 870,917 and Hippard U.S. Pat. No. 696,043.

A major deficiency of valley gutters of the prior art, including systems having a secondary gutter, is their susceptibility to leakage occasioned by thermal expansion or contraction. In contrast to the principal structural members of a building, which are thermally insulated from the exterior and remain approximately at room temperature, the valley gutter is directly exposed to the exterior and thus experiences appreciable thermal expansion or contraction relative to the adjacent structural portions of the roof. If the gutter is formed as a single integral member, either by starting with a single elongated gutter trough or by welding several shorter troughs together, all of the expansion or contraction of the gutter will occur at its ends, with the result that the gutter will inevitably tear loose from the adjacent building walls.

An alternative construction is to form the gutter of several telescoping sections, so as to reduce the relative expansion or contraction of the ends of any one section, and to use a sealant such as mastic at the joints between sections to minimize leakage. While this alternative form of construction preserves the watertight integrity of the gutter at its ends adjacent the building walls, it does so only by increasing the possibility of leakage along the length of the gutter, owing to the impossibility of maintaining a perfect seal at the joints. Nor does providing a secondary gutter beneath the primary gutter overcome these problems of the prior art. Like the primary gutter, the secondary gutter will either pull away from the building walls at its ends or suffer leakage at intermediate joints, depending on the mode of construction.

Barlow U.S. Pat. No 4,129,967 discloses a system for collecting fluid seepage through expansion joints between adjacent building slabs in which a flexible receiving member is disposed along the underside of the regions between the slabs. Since the receiving member is simply suspended from the building slabs and is supported only at its upper edges, it cannot hold any appreciable amount of seepage without risking the possibility of rupture or of separation from the slabs.

SUMMARY OF THE INVENTION

In general, our invention contemplates a gutter assembly for collecting drainage from a building portion, such as adjacent roof sections forming a valley, in which a primary gutter, preferably comprising a plurality of telescoping gutter sections, is disposed along the building portion, while a flexible liquid-impervious membrane extends continuously along the building portion beneath the primary gutter to catch any drainage escaping therefrom. To ensure against rupture of the flexible membrane from liquid pressure, a secondary gutter, also preferably comprising a plurality of telescoping gutter sections, supports the membrane along its length beneath the primary gutter.

OBJECTS OF THE INVENTION

One of the objects of our invention is to provide a gutter assembly which effectively collects the drainage from adjacent roof sections.

Another object of our invention is to provide a gutter assembly which minimizes the possibility of leakage between the gutter and the building walls at the ends thereof.

Still another object of our invention is to provide a gutter assembly which minimizes the possibility of leakage along the length of the gutter.

A further object of our invention is to provide a gutter assembly which minimizes the possibility of leakage between the joints of adjacent gutter sections.

A still further object of our invention is to provide a gutter assembly which can handle relatively large amounts of drainage without rupturing.

Yet another object of our invention is to provide a gutter assembly which is relatively impervious to the external environment.

Other and further objects will be apparent from the following description.

BRIEF DESCRIPTION OF THE DRAWINGS

In the accompanying drawings, which form part of the instant specification and which are to be read in conjunction therewith, and in which like reference numerals are used to indicate like parts in the various views:

FIGS. 1*a* and 1*b* constitute a simplified fragmentary section of a preferred embodiment of our gutter assembly.

FIG. 3 is an enlarged fragmentary section of the assembly of FIGS. 1*a* and 1*b* taken along line 3—3 of FIG. 2.

DESCRIPTION OF THE PREFERRED EMBODIMENT

Figure 1A:
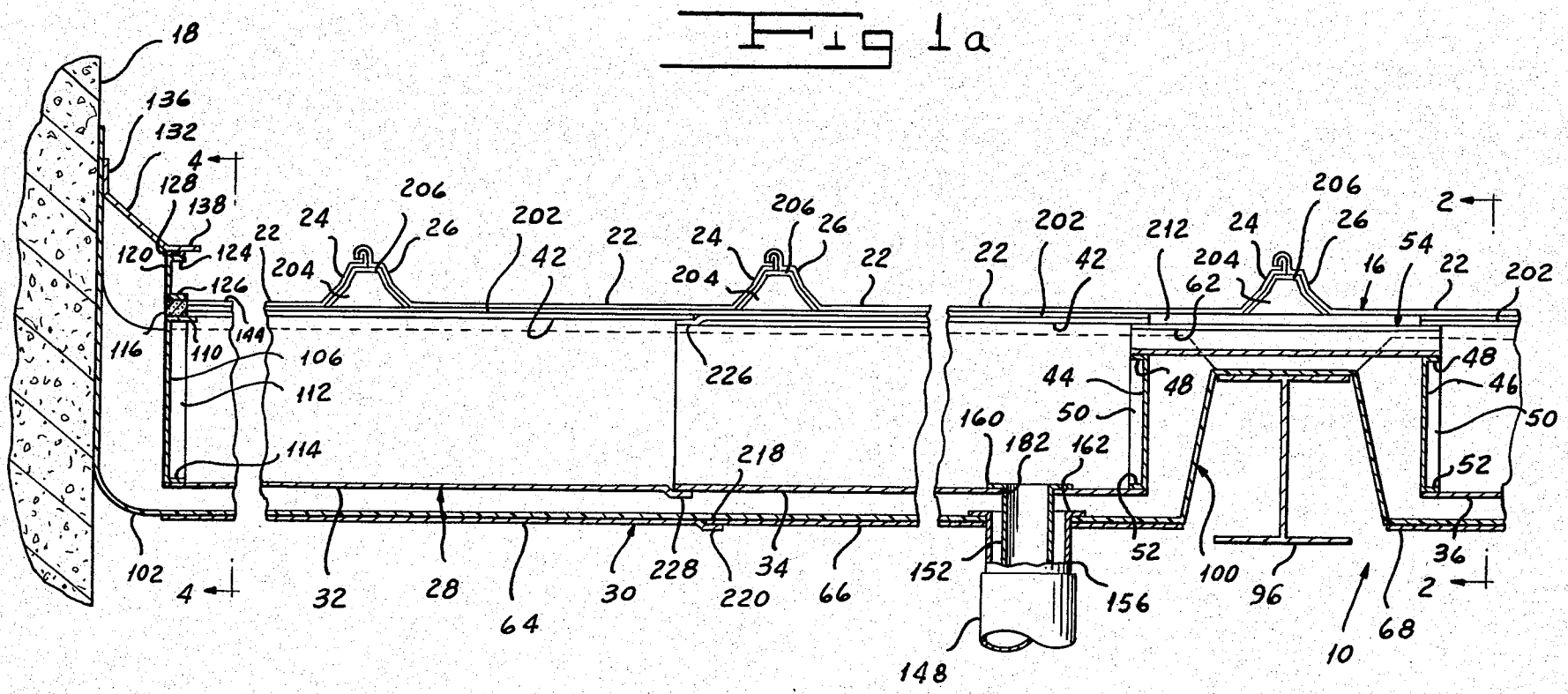

Referring now to the drawings, our gutter assembly, indicated generally by the reference numeral 10, is intended to cover the space, indicated generally by the reference character 12, between a left-side standing seam roof section, indicated generally by the reference numeral 14, and an adjacent right-side standing seam roof section indicated generally by the reference numeral 16. Roof sections 14 and 16 are spaced about 11 inches from each other to leave room for a channel for drainage, and slope upwardly from each other at an angle of about 2.5 degrees. Roof sections 14 and 16 each extend between a first masonry parapet wall 18 and a second masonry parapet wall 20 of the building portion (not shown) covered by roof sections 14 and 16.

Each of standing seam roof sections 14 and 16 comprises a plurality of roof panels 22 formed with male standing seam portions 24 along the sides nearest parapet wall 18 and female standing seam portions 26 adapted to fit over the portions 24 of an adjacent panel 22. Although the construction details of the roof panels 22 do not as such form part of our invention, a detailed description of the panels and the manner of their assembly may be found in the copending application of applicant Harold G. Simpson et al Ser. No. 425,477, filed Sept. 28, 1982, entitled "Improved Standing Seam Metal Floating Roof Assembly."

Figure 2:
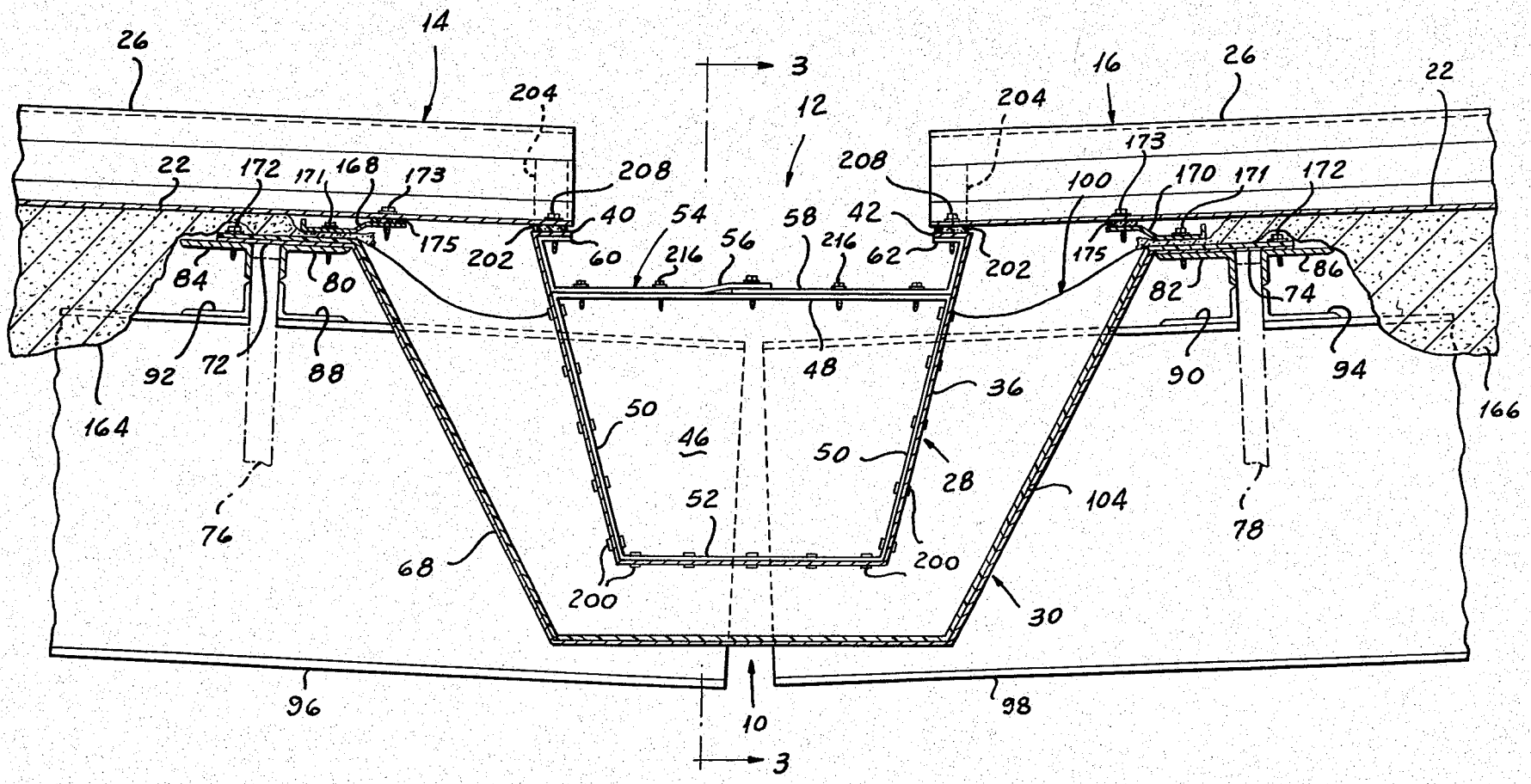
FIG. 2 is an enlarged fragmentary section of the gutter assembly shown in FIGS. 1*a* and 1*b*, taken along line 2—2 of FIG. 1*a*.
Figure 4:
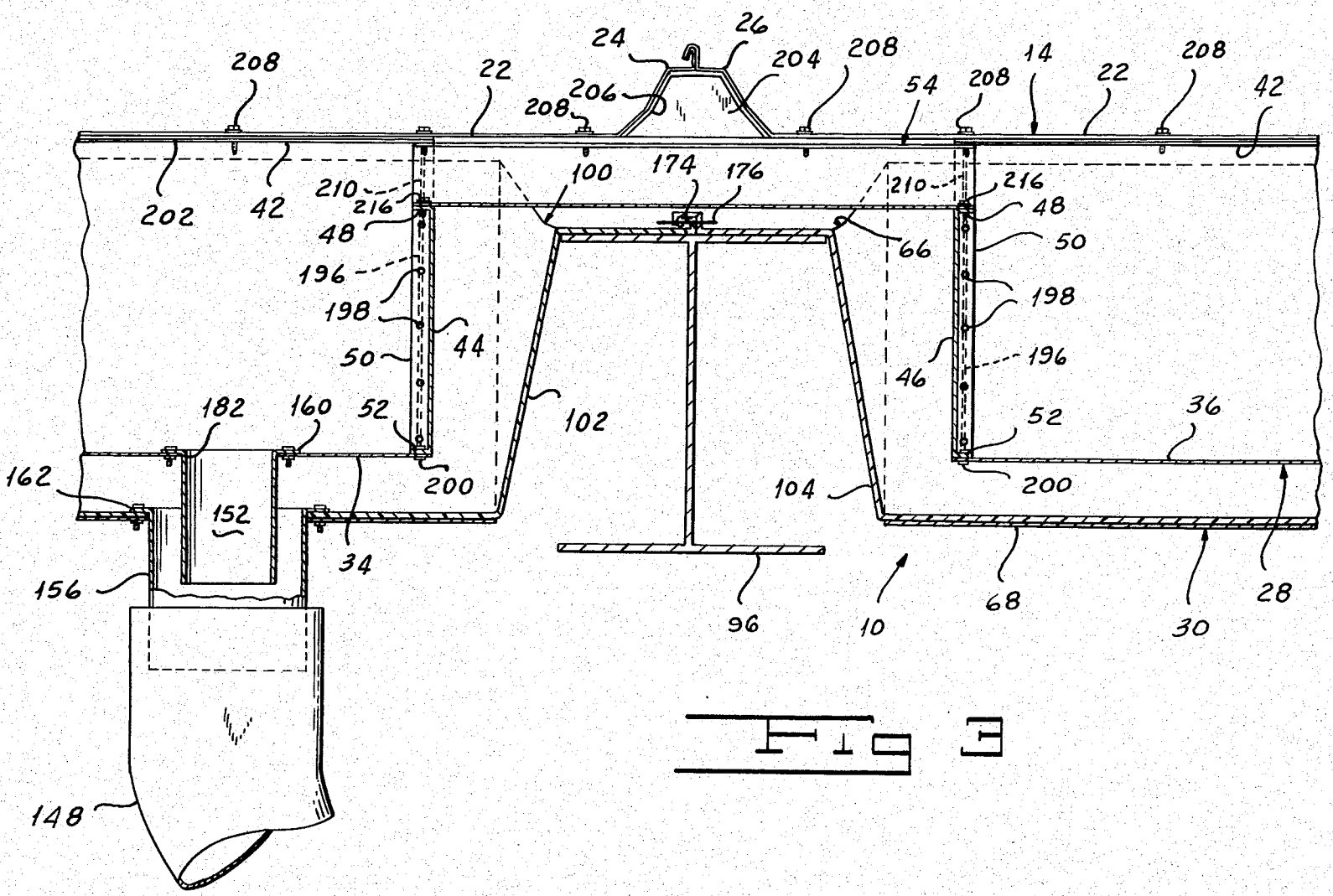
FIG. 4 is an enlarged fragmentary section of the gutter assembly of FIGS. 1*a* and 1*b* taken along line 4—4 of FIG. 1*a*.
Figure 4:
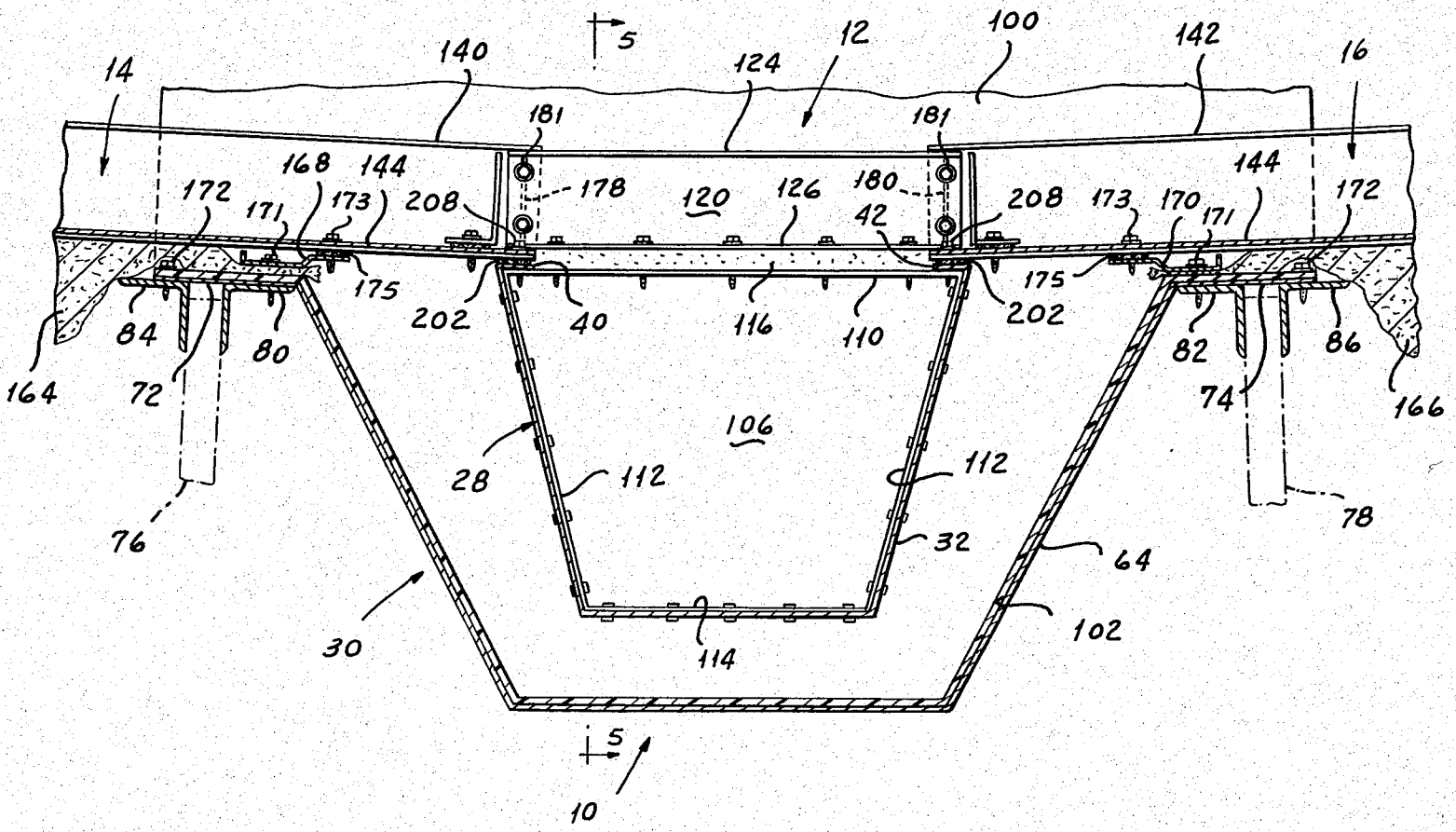

A center I-beam 96 extends perpendicularly of the space 12 beneath roof section 14. Beam 96 cooperates with end beams (not shown) adjacent parapet walls 18 and 20 to support joists 76, one of which is shown in FIGS. 2 and 4, extending between walls 18 and 20. Brackets 88 and 92 carried by the top flange of beam 96 are secured to the respective sides of joists 76 to locate the joists relative to beam 96. Joists 76 carry brackets 80 and 84 which extend along the respective upper edges of the joists to form top chords for supporting roof section 14 in a manner to be described. In a similar manner, a center I-beam 98 extends perpendicularly of space 12 beneath roof section 16. Beam 98 cooperates with end beams (not shown) adjacent parapet walls 18 and 20 to support joists 78 extending between walls 18 and 20. Brackets 90 and 94 carried by the top flange of beam 98 are secured to the respective sides of joists 78 to locate the joists relative to beam 98. Joists 78 carry brackets 82 and 86 which extend along the respective upper edges of the joists to form top chords for supporting roof section 16.

The gutter assembly 10 comprises a primary gutter, indicated generally by the reference numeral 28, extending between parapet walls 18 and 20 in the space 12 between the edges of roof sections 14 and 16 and a secondary gutter, indicated generally by the reference numeral 30, extending between parapet walls 18 and 20 beneath the primary gutter 28 to collect any drainage that may escape therefrom.

The primary gutter 28 comprises trough-shaped gutter pans 32, 34, 36 and 38, which are assembled relative to one another and to adjacent roof sections 14 and 16, in a manner to be described, starting at parapet wall 18 and ending at parapet wall 20. Preferably, gutter pans 32, 34, 36 and 38 comprises precut metal sections of about 20 feet in length. Individual gutter pans may be field-cut, however, to accommodate roof support beams 96 and 98, which extend into the space 12, as well as to accommodate the end parapet wall 20. Each of the primary valley gutter pans 32, 34, 36 and 38 is formed with inwardly extending upper lips 40 and 42 along the length of the pan to permit attachment to the underside of respective roof sections 14 and 16 with fasteners such as screws 208, shown in FIGS. 2 and 5. Preferably, to prevent fluid leakage between the undersides of roof sections 14 and 16 and lips 40 and 42, layers 202 of mastic sealant of any suitable type known to the art are applied to the upper surfaces of lips 40 and 42 before their attachment to the respective roof sections 14 and 16.

Since roof supporting beams 96 and 98 extend into the space 12 along which the gutter pans 32 to 38 are arranged, primary gutter pan 34 must terminate at a point just before the beams, while gutter pan 36 must start at a point just after the beams with respect to the direction of erection of the gutter assembly from wall 18 to wall 20. Respective end caps 44 and 46 enclose the lower portions of gutter pans 34 and 36 adjacent to beams 96 and 98. Each of end caps 44 and 46 is formed with an upper lip 48, side lips 50 and a lower lip 52. Lips 50 and 52 fit inside the immediately adjacent end portions of gutter pan 34 or 36, and are secured to the pan by suitable means such as pop rivets 200, shown in FIGS. 2 and 3. Referring to FIG. 3, layers of mastic 196 between lips 50 and 52 of caps 44 and 46 and the adjacent portions of pans 34 and 36 seal the interface between the adjacent pairs of members.

A cap flash indicated generally by the reference numeral 54 bridges the gap in the primary valley gutter 28 between gutter pans 34 and 36. Preferably cap flash 54 comprises respective left and right sections 56 and 58 which are secured together in the course of assembly in a manner to be described. Each of the cap flash sections 56 and 58 is formed with a generally horizontal lower surface portion adapted to mate with the upper lips 48 of end caps 44 and 46, side portions adapted to fit inside the corresponding upper side portions of gutter pans 34 and 36, and respective inwardly extending upper lips 60 and 62 adapted to fit inside lips 40 and 42 of gutter pans 34 and 36.

The primary gutter 28 also includes respective full-height end caps 106 and 108, which enclose the respective end portions of gutter pans 32 and 38 adjacent to parapet walls 18 and 20. Each of the end caps 106 and 108 is formed with an upper lip 110, side lips 112 and a lower lip 114. Side lips 112 and lower lip 114 mate with the inner surfaces of the adjacent gutter pans in a manner similar to that of the lips 50 and 52 of end caps 44 and 46.

The secondary gutter 30 includes trough-shaped pans 64, 66, 68 and 70 disposed generally below the corresponding pans 32, 34, 36 and 38 of the primary gutter 28. As shown in FIGS. 2 and 4, each of the secondary gutter pans 64, 66, 68 and 70, is formed with outwardly extending upper lips 72 and 74 to permit attachment to the brackets 80, 84 and 82, 86 forming the top chords of respective joists 76 and 78. As shown in FIGS. 1*a* and 1*b*, the initially erected secondary gutter pan 64 starts at a point slightly spaced from the adjacent parapet wall 18, while the finally erected gutter pan 70 is terminated at a point spaced slightly from parapet wall 20. In a manner similar to that of intermediate primary gutter pans 34 and 36, secondary gutter pan 66 is terminated at a point before the supporting beams 96 and 98, while secondary gutter pan 68 starts at a point slightly following the same beams 96 and 98.

In accordance with our invention, secondary gutter pans 64 to 70 support a flexible, liquid-impervious membrane 100, comprising sections 102 and 104 joined in a manner to be described. Membrane 100 extends continuously along the upper surfaces of the pans 64 to 70 between parapet walls 18 and 20. As shown in FIGS. 1*a* and 3, the membrane 100 is draped over the beams 96 and 98 supporting roof sections 14 and 16 to shield these structural members from the external environment. Membrane 100 is laterally coextensive with the outwardly extending lips 72 and 74 of gutter pans 64 to 70, forming in effect a liquid-tight trough underlying the primary gutter 28. Membrane 100 also extends upwardly at its ends, along the surfaces of parapet walls 18 and 20, to form an effective seal at the ends of the secondary gutter 30.

Figure 5:
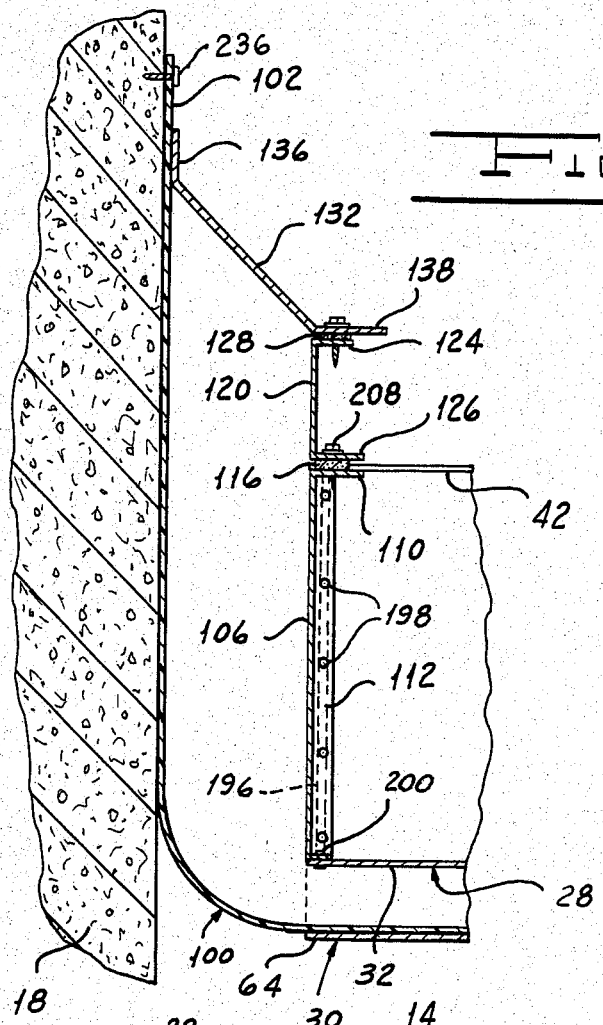
FIG. 5 is a fragmentary section of the gutter assembly of FIGS. 1*a* and 1*b* taken along line 5—5 of FIG. 4.

Referring now to FIGS. 1*a*, 4 and 5, a generally vertically and transversely extending rake channel end piece 120 is formed with a lower lip 126 that mates with the upper lip 110 of end cap 106. A layer of mastic sealant 116 provides a liquid-impervious seal between end piece 120 and end cap 106. A rake parapet flash 132 (not shown in FIG. 4) extending generally at a 45° angle as viewed in FIGS. 1*a* and 5 is formed with a lower flange 138, which mates with an upper lip 124 of end piece 120, and with an upper flange 136 which mates with the end portion of flexible membrane 100 extending upwardly along parapet wall 18. A layer of mastic sealant 128 provides a liquid-impervious seal between parapet flash 132 and end piece 120. As shown in FIG. 4, rake channel end piece 120 is also secured at its ends to rake channels 140 and 142 carried by respective sloping roof sections 14 and 16. Referring also to FIG. 1*a*, suitable-length starter panels 144, similar to roof panels 22 but lacking a female standing-seam portion, bridge the gap between the intermediate roof panels 22 and rake channels 140 and 142 and end piece 120.

Referring now to FIG. 1*b*, a generally vertically and transversely extending rake channel end piece 122 is formed with a lower lip 126 that mates with the upper lip 110 of end cap 108. A layer of mastic sealant 118 provides a liquid-impervious seal between end piece 122 and end cap 108. A rake parapet flashing 134 extending generally at a 45° angle as viewed in FIG. 1*b* is formed with a lower flange 138 which mates with a corresponding upper lip 124 of end piece 122 and with an upper flange 136 which mates with the end portion of flexible membrane 100 extending upwardly along parapet wall 20. A layer of mastic sealant 130 provides a liquid-impervious seal between parapet flashing 134 and end piece 122. Rake channel end piece 122 is secured at its ends in a manner similar to end piece 120, to respective rake channels (not shown) carried by sloping roof sections 14 and 16. Suitable-length finish panels 146, similar to roof panels 22 but lacking a male standing seam portion, bridge the gap between the intermediate roof panels 22 and end piece 122.

The building (not shown) covered by roof sections 14 and 16 is provided with downspouts 148 and 150 at locations spaced along the gutter assembly 10, adjacent to secondary gutter pans 66 and 70, respectively. Downspout 148 receives the lower end of a generally cylindrical secondary gutter drop 156, the upper end of which extends through openings formed in secondary gutter pan 66 and membrane 100. An outwardly extending upper lip 162 of gutter drop 156 locates the gutter drop relative to the pan 66. Coaxially disposed inside of secondary gutter drop 156 is a smaller-diameter primary gutter drop 152, the upper end of which extends through a drop hole 182 in primary gutter pan 34. An outwardly extending lip 160 at the upper end of primary gutter drop 152 locates the gutter drop relative to pan 34.

In a similar manner, downspout 150 receives the lower end of a generally cylindrical gutter drop 158, the upper end of which extends through openings formed in secondary gutter pan 70 and membrane 100. An outwardly extending upper lip 162 locates gutter drop 158 relative to pan 70. A smaller-diameter primary gutter drop 154 disposed coaxially inside of secondary gutter drop 158 extends through a drop hole 184 formed in primary gutter pan 38. An outwardly extending flange 160 at the upper end locates the gutter drop 154 relative to pan 38.

The first step in assembling the valley gutter 10, which is performed prior to erecting roof sections 14 and 16, is to assemble the secondary gutter assembly 30, comprising pans 64 to 70 and membrane 100, in place over beams 96 and 98 and joists 76 and 78. After ascertaining the location of the downspouts 148 and 150 to which the secondary gutter 30 is coupled, the secondary gutter pans 66 and 70 with previously formed drop holes are placed over joists 76 and 78 so that the drop holes are aligned with downspouts 148 and 150. Thereafter, the remaining secondary gutter pans 64 and 68 are assembled in place.

Figure 8:
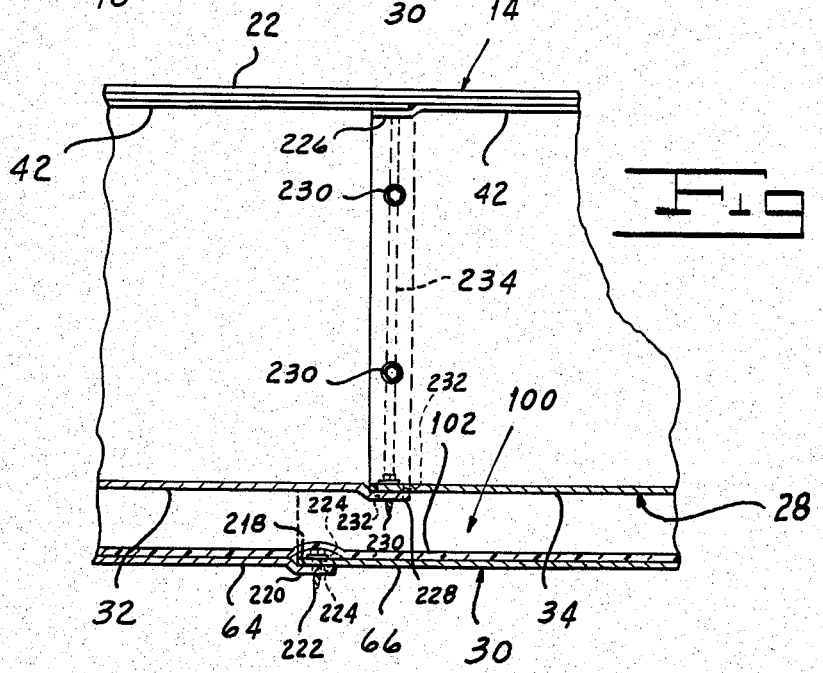
FIG. 8 is an enlarged fragmentary section of the assembly shown in FIGS. 1*a* and 1*b*, illustrating the manner in which adjacent gutter sections are joined.

Referring to FIGS. 1*a*, 1*b* and FIG. 8, gutter pans 66 and 70 are formed with end portions 218 adapted to telescope inside adjacent end portions 220 of respective pans 64 and 68. Any suitable fasteners such as screws 222 received in holes 224 may be used to secure adjacent end portions 218 and 220. If desired, rather than being secured together as shown, pans 64 and 68 may be lapped or butted around pans 66 and 70, respectively, to minimize the need for field-cutting of the gutter pans. No mastic is required on the joints between pans 64 and 66 and pans 68 and 70, since the flexible membrane 100 later to be installed provides the water-tight gutter function. Gutter pans 66 and 68 are terminated a suitable distance from beams 96 and 98, while gutter pans 64 and 70 are similarly terminated a suitable spacing from parapet walls 18 and 20, to avoid any possibility of contact with these structural members in the course of expansion or contraction relative thereto.

After gutter pans 64, 66, 68 and 70 have been positioned on joists 76 and 78 and assembled relative to one another in the manner described above, they are secured to the brackets 84 and 86 forming part of the top chords of joists 76 and 78, respectively, by means of suitable fasteners such as screws 172. Next, the flexible membrane 100 is installed along the secondary gutter pans 64 to 70. This is done by laying the membrane 100 down in the gutter pans 64 to 70, as shown in FIGS. 1*a* and 1*b*, and attaching the membrane to the brackets 84 and 86 of joists 76 and 78 with fasteners (not shown) such as the screws 172 used to secure the secondary gutter pans to the same brackets. The fasteners for the membrane 100 may, for example, alternate along the same line with the screws 172 securing the secondary gutter pans 64 to 70 to brackets 84 and 86. We also draw the end portions of membrane 100 upwardly and secure these portions to parapet walls 18 and 20 using suitable fasteners such as screws 236.

If, as in the embodiment shown, the flexible membrane is formed of separate sections 102 and 104, these sections are spliced at a point overlying roof beams 96 and 98. To splice membrane sections 102 and 104, the adjacent edges of the sections 102 and 104 are brought up over the beams 96 and 98 as shown in FIG. 3. We then position a strip 174 of tape mastic between the two sections 102 and 104 and press the sections firmly together, roll them up and fasten them together, preferably with insulation vapor barrier staples 176.

After the membrane 100 has been installed in the secondary gutter 30 in this manner, apertures are formed in the membrane in registry with the drop holes in gutter pans 66 and 70, and gutter drops 156 and 158 are installed in the secondary gutter at positions aligned with respective downspouts 148 and 150. Gutter drops 156 and 158 are installed in a manner similar to that of gutter drops 152 and 154, described below.

With the installation of the flexible membrane 100 and gutter drops 156 and 158, the assembly of the secondary valley gutter 30 is complete, the roof sections 14 and 16 can then be erected upon joists 76 and 78, respectively. The manner of erection of roof sections 14 and 16, while not forming as such a part of our invention, is described in detail in the previously referred to copending application Ser. No. 425,477, filed Sept. 28, 1982. As a preliminary to erection of roof sections 14 and 16 in the manner therein described, we secure respective left-side and right-side eave plates 168 and 170, extending along the space 12, to brackets 80 and 82 of the top chords of joists 76 and 78 using any suitable fasteners such as screws 171.

Referring to FIG. 2, sandwiched between eave plates 168 and 170 and the corresponding brackets 80 and 82 are the edge portions of respective layers 164 and 166 of blanket insulation underlying roof sections 14 and 16, as well as the outwardly extending edge portions of gutter pans 64 to 70 and flexible membrane 100. As shown in the same figure, screw fasteners 173 secure the upper edges of eave plates 168 and 170 to the undersides of the panels 22 constituting respective roof sections 14 and 16. Layers of mastic sealant 175 between eave plates 168 and 170 and the panels 22 of respective roof sections 14 and 16 complete the liquid seal between the roof sections and the secondary valley gutter 30.

Following the installation of roof sections 14 and 16, the primary valley gutter 28 is assembled in place beneath the adjacent edges of the panels 22 constituting roof sections 14 and 16. As a preliminary to installation of primary gutter pans 32, 34, 36 and 38, we install rake channel end pieces 120 and 122 between the rake channels 140 and 142 at each end of the gutter 10. We do this by first applying strips of tape mastic 178 and 180 along the ends of the rake channel end pieces 120 and 122, as shown for end piece 120 in FIG. 4, and then inserting end pieces 120 and 122 in place and attaching them to rake channels 140 and 142 using suitable fasteners such as screws 181. Parapet flashings 132 and 134 may then be installed in the positions shown in FIGS. 1*a*, 1*b* and 5.

We then assemble gutter pans 32 and 34 as well as pans 36 and 38 prior to their fitting with end caps 44, 46, 106 and 108 and attachment to roof sections 14 and 16. Referring to FIGS. 1*a*, 1*b*, and 8, gutter pans 34 and 38 are formed with end portions 226 adapted to telescope inside adjacent end portions 228 of respective pans 32 and 36. Any suitable fasteners such as screws 230 may be used to secure adjacent end portions 226 and 228. The holes 232 in end portions 226 and 228 receiving the screws 230 may be originally circular. Eventually, however, they become elongated in the direction of space 12, as shown in FIG. 8, as a result of the continual relative movement of the adjacent pan portions 226 and 228 due to expansion and contraction. Preferably, to minimize leakage into the secondary valley gutter 30, a layer of gun-grade mastic 234 is applied between each pair of end portions 226 and 228. While, in the embodiment shown, two gutter pans 32 and 34 are used between parapet wall 18 and beams 96 and 98, and another two pans 36 and 38 are used between beams 96 and 98 and parapet wall 20, it will be apparent to those skilled in the art that the number and length of gutter pans in any one section will depend on the relative separation of the parapet walls 18 and 20 and intervening members such as beams 96 and 98.

Figures 6, 7, 9:
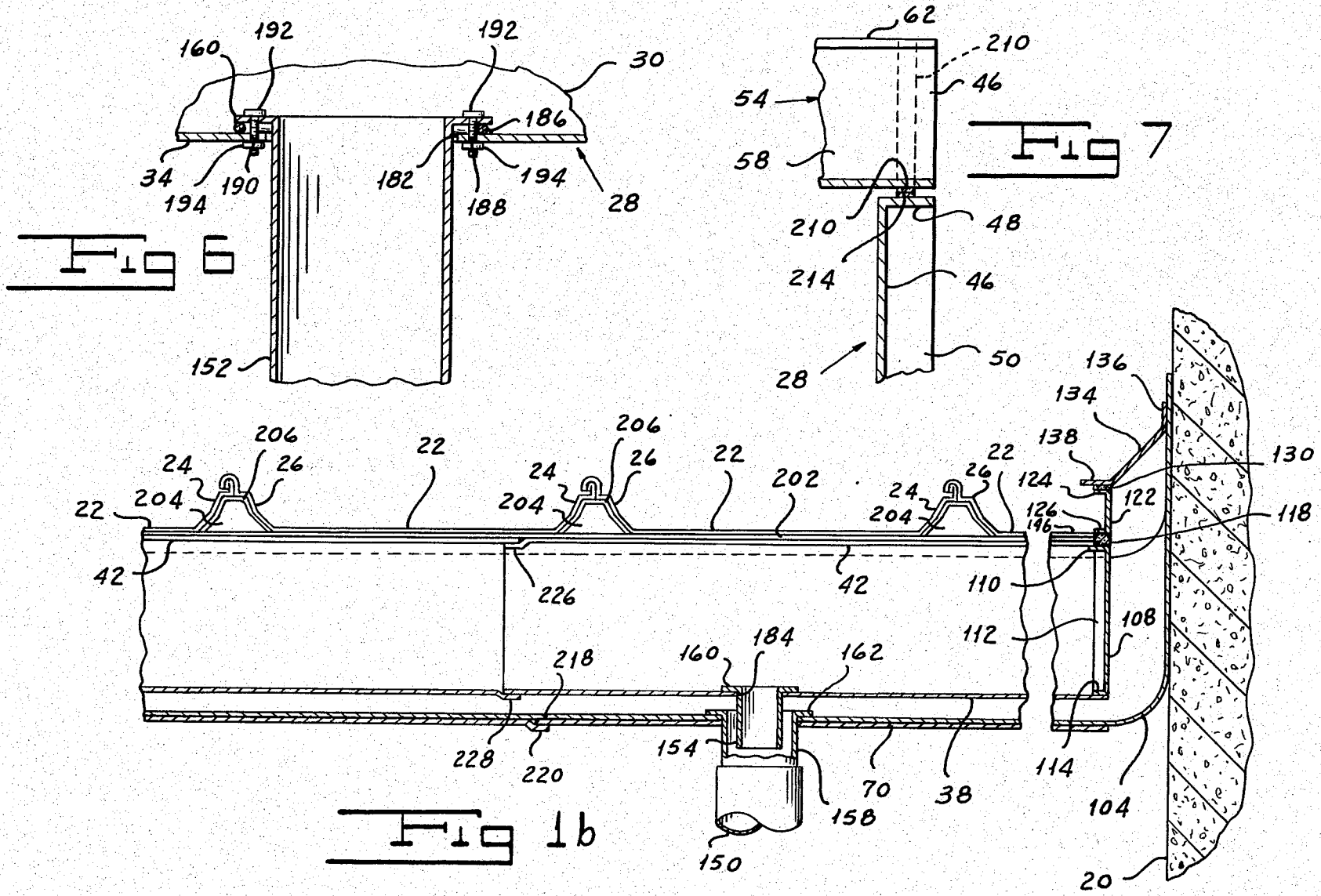
FIG. 6 is an enlarged section of the primary gutter drop shown in FIG. 1*a*, illustrating the mounting of the gutter drop in the bottom of the gutter pan.
FIG. 7 is an enlarged fragmentary section of one of the intermediate end caps of the gutter assembly of FIGS. 1*a* and 1*b*, illustrating the seal formed between the end cap and cap flashing.

The primary gutter 28 comprising pans 32, 34, 36 and 38 is then laid in position beneath the edges of roof sections 14 and 16 adjacent the valley 12, and the desired positions for the drop holes 182 and 184 are marked using a carpenter's square (not shown) as a guide. The drop holes 182 and 184 are then field-cut in the bottoms of gutter pans 34 and 38, respectively. Referring now particularly to FIG. 6, annular layers of mastic 186 are then applied around the upper surface portions of the bottoms of pans 34 and 38 adjacent holes 182 and 184. Primary gutter drops 152 and 154 are then inserted downwardly through respective drop holes 182 and 184 so that the retaining lips 160 cover the mastic layers 186. Starter holes 188 of suitable diameter are then drilled through gutter pans 34 and 38, and suitable fasteners such as bolts 192 are then inserted in the holes 188 and tightened relative to nuts 194 to secure the lips 160 at one location. Using the lips 160 as guides, the remaining holes 190 are then drilled through gutter pans 34 and 38, and the remaining bolts 192 are inserted through holes 190 and tightened relative to nuts 194 to secure gutter drops 152 and 154 to pans 34 and 38, respectively.

Referring to FIGS. 3 and 5, after installing gutter drops 152 and 154, we apply layers 196 of tape mastic along the inside surfaces of primary gutter pans 32, 34, 36 and 38 adjacent their ends. Next, referring also to FIGS. 1*a* and 1*b*, we fit full-height end caps 106 and 108 over the layers of mastic 196 applied to the ends of pans 32 and 38, respectively. In a similar manner, we then place reduced-height end caps 44 and 46 over the mastic layers 196 applied to the exposed ends of intermediate pans 34 and 36. Suitable fasteners such as the previously mentioned pop rivets 200 are then inserted into previously formed holes 198 to secure end caps 106, 44, 46 and 108 to gutter pans 32, 34, 36 and 38, respectively. In FIGS. 3 and 5, the rivets 200 securing the side lips 50 of end caps 44 and 46 and side lip 112 of end cap 106 have been omitted to show the holes 198.

Following the installation of end caps 44, 46, 106 and 108, we apply strips 202 of tape mastic along the upper surfaces of the lips 40 and 42 of each of the gutter pans 32 to 38. Preferably the tape mastic 202 is initially applied to the gutter lips 40 and 42 with a paper backing (not shown) along the upper surface, which is not removed at this time.

Next, the respective mastic layers 206 are applied to panel closures 204 for sealing off the openings defined by adjacent standing seam portions 24 and 26. The closures 204 are then inserted into the openings, flush with the ends of panels 22, as shown in FIGS. 1*a*, 1*b*, 2 and 3. We then apply respective strips 116 and 118 along the upper lips 110 of gutter end dams 106 and 108 adjacent parapet walls 18 and 20. The paper backing (not shown)

is then removed from the mastic layers 202 previously applied to the lips 40 and 42 of gutter pans 32 to 38 and the entire primary gutter assembly 28 is raised into place uniformly, the gutter lips 40 and 42 being aligned with the edges of respective roof sections 14 and 16 and the end dams 106 and 108 being aligned with the lower lips 126 of respective end pieces 120 and 122. Using C-clamp vise grips (not shown), we temporarily clamp the primary gutter 28 into position. We then insert screw fasteners 208 at spaced locations along the length of the gutter 28 and across its ends to secure gutter lips 40 and 42 to respective roof sections 14 and 16, as well as to secure end caps 106 and 108 to respective end pieces 120 and 122.

Referring now to FIGS. 3 and 7, layers of mastic 210 are then applied along the upper lips 48 of the primary gutter end caps 44 and 46 adjacent roof beams 96 and 98, as well as along the interior surfaces of gutter pans 34 and 36 above end caps 44 and 46. Referring now to FIGS. 1*a* and 3, we then apply a layer of tape mastic 212 along the upper surface of lip 62 of the right hand cap flashing piece 58. Referring now to FIG. 7, we now apply a mastic layer 214 along the underside of cap flashing piece 58 adjacent to the upper edges 48 of end caps 44 and 46. Cap flashing piece 58 is then rotated into the position shown in FIGS. 2 and 3. In a similar manner, we then prepare the left-hand cap flashing piece 56 with mastic layers (not shown) similar to the layers 212 and 214 applied to cap flashing piece 58. Cap flashing piece 56 is then rotated into the position shown in FIG. 2. Suitable fasteners such as screws 216 are then inserted into cap flashing pieces 56 and 58 along their junction with end caps 44 and 46, as well as along their region of mutual overlap, to secure the pieces 56 and 58 in place.

To summarize the above description, any drainage from roof sections 14 and 16 that leaks through the mastic layers 234 of the joints between pans 32 and 34 and pans 36 and 38 of primary gutter 28 is collected by the continuous flexible membrane 100 of secondary gutter 30, from which the drainage passes into downspouts 148 and 150 through the gutter drops 156 and 158. Since the membrane 100 extends upwardly along the sides of the secondary gutter 30, as well as at the ends adjacent parapet walls 18 and 20, the drainage is also effectively confined along the sides and at the ends of the secondary gutter 30. The construction of the primary and secondary gutter pans 32 to 38 and 64 to 70 in the form of relatively short sections minimizes the relative expansion or contraction of any one section, minimizing in turn the forces tending to tear the sections apart from the adjacent building portions and thereby cause leakage. The secondary gutter pans 64 to 70 do not themselves collect drainage, but physically support the membrane 100 to enable it to handle relatively large amounts of drainage without rupture. Finally, the superposed location of the primary gutter 28 relative to the membrane 100 provides the membrane with effective protection from the external environment, without which protection the membrane could deteriorate in a very short time.

It will be seen that we have accomplished the objects of our invention. Our gutter assembly effectively collects the drainage from two adjacent sloping roof sections. Further, our gutter assembly minimizes leakage between the gutter and the building walls at the ends of the gutter, while at the same time minimizing leakage along the length of the gutter, in particular leakage between the joints of adjacent gutter sections. Our gutter assembly can handle relatively large amounts of drainage without rupturing. Finally, our gutter assembly is relatively impervious to the external environment.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A gutter assembly for collecting drainage from a building portion including in combination a primary gutter extending along said building portion, a flexible liquid-impervious membrane extending continuously along said building portion beneath said primary gutter, and a secondary gutter extending along said building portion supporting said membrane.

2. A gutter assembly as in claim 1 in which said membrane includes upwardly extending end portions spaced along said building portion.

3. In a roof assembly in which two adjacent roof sections slope downwardly toward each other to form a valley, a gutter assembly for collecting drainage from said valley including in combination a primary gutter extending along said valley, a flexible liquid-impervious membrane extending continuously along said valley beneath said primary gutter, and a secondary gutter extending along said valley supporting said membrane.

4. A gutter assembly as in claim 3 in which said membrane includes portions extending upwardly along the sides of said valley to form a trough.

5. A gutter assembly as in claim 3 in which said membrane includes portions extending upwardly along the sides of said valley to form a trough, said secondary gutter having portions laterally coextensive with said portions of said membrane.

6. A gutter assembly as in claim 3 in which said membrane includes portions extending upwardly along the sides of said valley to form a trough and upwardly extending end portions spaced along said valley.

7. A gutter assembly for collecting drainage from a building portion including in combination a plurality of relatively movable primary gutter sections arranged at adjacent locations along said building portion, a flexible liquid-impervious membrane extending continuously along said building portion beneath said primary gutter sections, and a plurality of relatively movable secondary gutter sections supporting said membrane at adjacent locations along said building portions.

8. A gutter assembly as in claim 7 in which adjacent primary gutter sections are mounted for telescoping movement relative to each other.

9. A gutter assembly as in claim 7 in which adjacent secondary gutter sections are mounted for telescoping movement relative to each other.

10. A gutter assembly as in claim 7 in which adjacent primary gutter sections and adjacent secondary gutter are mounted for telescoping movement relative to each other.

11. In a roof assembly in which two adjacent roof sections slope downwardly toward each other to form a valley, a gutter assembly for collecting drainage from said valley including in combination a primary gutter extending along said valley beneath the adjacent portions of said roof sections, said primary gutter cooperating with said roof sections to form an enclosed area, and a secondary gutter extending along said valley beneath said primary gutter, said secondary gutter being so constructed as to collect any drainage entering said enclosed area between either of said roof sections and said primary gutter.

12. A gutter assembly as in claim 11 in which said secondary gutter is substantially wider than said primary gutter.

13. A gutter assembly as in claim 11 in which said secondary gutter includes respective sidewalls extending substantially to the level of said roof sections.

14. A gutter assembly as in claim 11 in which each of said primary and secondary gutters comprises a plurality of relatively movable sections arranged at adjacent locations along said valley.

15. A gutter assembly as in claim 11 in which each of said primary and secondary gutters comprises a plurality of telescoping sections arranged at adjacent locations along said valley.

16. A gutter assembly as in claim 11 in which each of said primary and secondary gutters comprises a plurality of relatively movable sections arranged at adjacent locations along said valley, said assembly further including a flexible liquid-impervious membrane extending continuously along said valley along the upper surface of said secondary gutter.

17. In a roof assembly in which two adjacent roof sections slope downwardly toward each other to form a valley, a gutter assembly for collecting drainage from said valley including in combination a primary gutter extending along said valley beneath the adjacent portions of said roof sections, means forming a primary seal between each of said roof sections and said primary gutter, a secondary gutter extending along said valley beneath said primary gutter, and means forming a secondary seal independent of said primary seal between each of said roof sections and said secondary gutter.

18. A gutter assembly as in claim 17 in which each of said primary and secondary gutters comprises a plurality of relatively movable sections arranged at adjacent locations along said valley.

19. A gutter assembly as in claim 17 in which each of said primary and secondary gutters comprises a plurality of telescoping sections arranged at adjacent locations along said valley.

20. A gutter assembly as in claim 17 in which each of said primary and secondary gutters comprises a plurality of relatively movable sections arranged at adjacent locations along said valley, said assembly further including a flexible liquid-impervious membrane extending continuously along said valley along the upper surface of said secondary gutter.

* * * * *

UNITED STATES PATENT AND TRADEMARK OFFICE

CERTIFICATE OF CORRECTION

PATENT NO. : 4,528,784

DATED : July 16, 1985

INVENTOR(S) : Harold G. Simpson and Leo E. Neyer

It is certified that error appears in the above-identified patent and that said Letters Patent is hereby corrected as shown below:

Column 10, line 61, after "secondary gutter"

insert -- sections --.

Signed and Sealed this

*Tenth* Day of *December 1985*

[SEAL]

*Attest:*

DONALD J. QUIGG

*Attesting Officer*

*Commissioner of Patents and Trademarks*